United States Patent [19]

New

[11] Patent Number: 5,001,771

[45] Date of Patent: Mar. 19, 1991

[54] COMMUNICATIONS JAMMER

[75] Inventor: Anthony M. New, Bristol, England

[73] Assignee: British Aerospace Public Limited Company, London, England

[21] Appl. No.: 198,883

[22] Filed: May 26, 1988

[30] Foreign Application Priority Data

May 27, 1987 [GB] United Kingdom ..... 8712393

[51] Int. Cl.[5] ..... H04K 3/00

[52] U.S. Cl. ..... 455/1; 455/103; 455/73; 342/14

[58] Field of Search ..... 455/1, 103, 73, 79; 342/14, 15, 16; 331/78

[56] References Cited

U.S. PATENT DOCUMENTS

| | | | |
|---|---|---|---|
| 3,431,496 | 3/1969 | O'Donnell | 455/1 |
| 4,214,208 | 7/1980 | O'Donnell | 455/1 |
| 4,313,207 | 1/1982 | Nardozza et al. | 455/1 |
| 4,357,709 | 11/1982 | Butler et al. | 455/1 |
| 4,498,193 | 2/1985 | Richardson | 455/1 |
| 4,644,299 | 2/1987 | Amoroso et al. | 455/1 |
| 4,719,649 | 1/1988 | Woodsum et al. | 455/1 |

FOREIGN PATENT DOCUMENTS

| | | | |
|---|---|---|---|
| 0293167 | 11/1988 | European Pat. Off. | 455/1 |
| 1450761 | 9/1961 | United Kingdom . | |
| 1278771 | 7/1963 | United Kingdom . | |

*Primary Examiner*—Douglas W. Olms
*Assistant Examiner*—Ralph Smith
*Attorney, Agent, or Firm*—Cushman, Darby & Cushman

[57] ABSTRACT

A jammer includes means for receiving a local radio transmission and means for determining the frequency of the local radio transmission. Monitoring circuits are arranged to detect the end of the local radio transmission and only then to trigger the transmission of a jamming signal by jamming signal transmitting means. In this manner the jammer jams local reception of the response of a non-local station to the detected local transmission. The jammer is able to jam effectively using a low power signal. The reduction in the power-consumption of the jammer makes it particularly suitable for use as a leave-behind jammer for military applications.

9 Claims, 2 Drawing Sheets

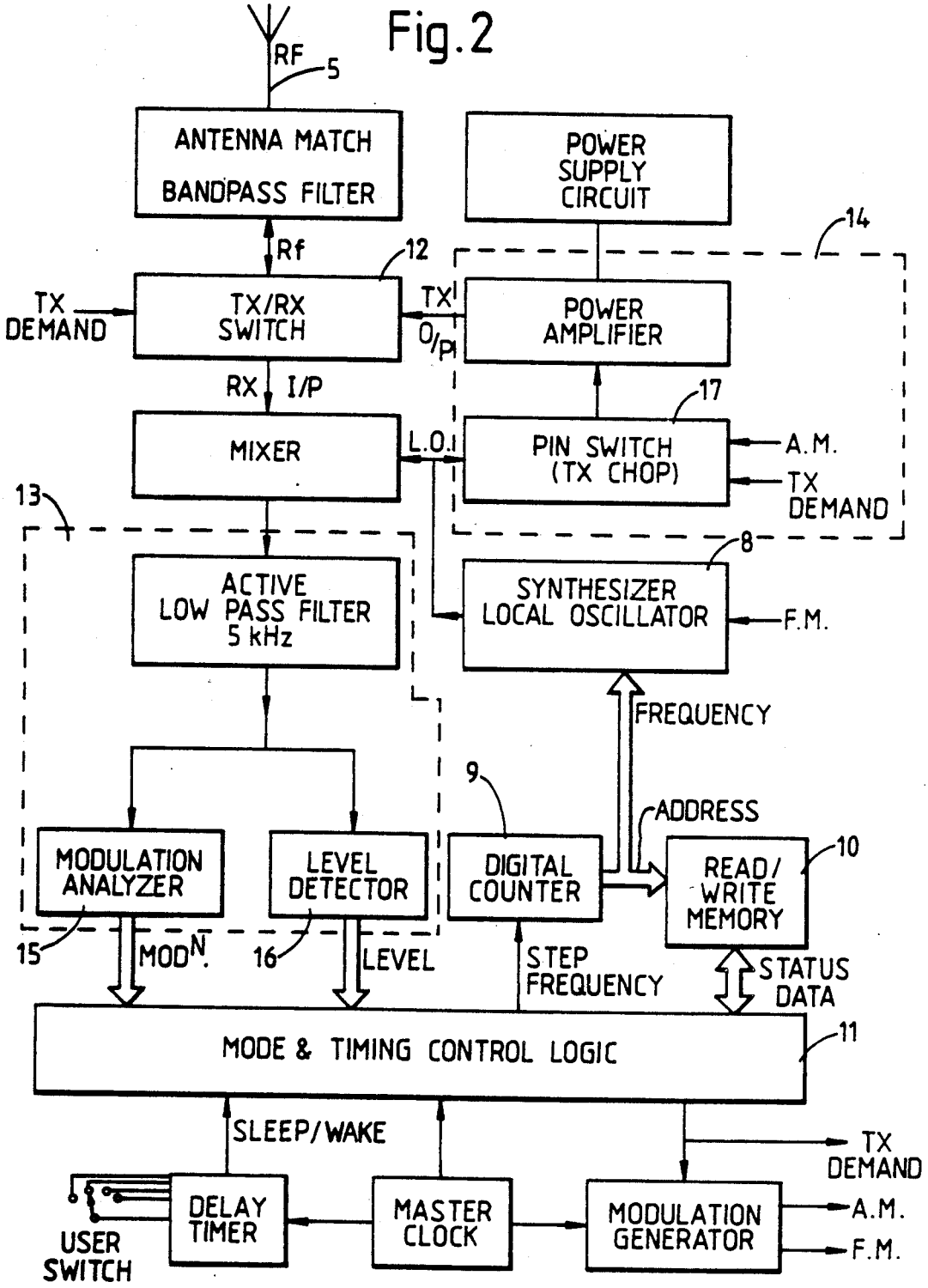
Fig. 2
RF
5
ANTENNA MATCH
BANDPASS FILTER
POWER SUPPLY CIRCUIT
14
Rf
12
TX DEMAND
TX/RX SWITCH
TX
O/P
POWER AMPLIFIER
RX
I/P
17
MIXER
L.O.
PIN SWITCH (TX CHOP)
A.M.
TX DEMAND
13
8
ACTIVE LOW PASS FILTER 5 kHz
SYNTHESIZER LOCAL OSCILLATOR
F.M.
FREQUENCY
9
ADDRESS
MODULATION ANALYZER
LEVEL DETECTOR
DIGITAL COUNTER
READ/ WRITE MEMORY
10
15
MODN.
16
LEVEL
STEP FREQUENCY
STATUS DATA
MODE & TIMING CONTROL LOGIC
11
SLEEP/WAKE
TX DEMAND
DELAY TIMER
MASTER CLOCK
MODULATION GENERATOR
A.M.
F.M.
USER SWITCH

COMMUNICATIONS JAMMER

BACKGROUND OF THE INVENTION

The present invention relates to methods of, and apparatus for jamming radio communication systems and in particular to what are known as "leave-behind jammers". Such devices are designed for military use, being left during strategic withdrawal from an area so that after the area is over-run by hostile forces the jammers disrupt communications systems in the vicinity To be effective many such jammers need to be deployed in order to cover the many transmissions likely in a complex communications system and to provide sufficient redundancy for jamming still to be effective even after a proportion of the jammers have been detected and disabled. Ideally therefore the jammers should be rugged, portable and sufficiently inexpensive to be regarded as expendable.

Known methods of jamming fall broadly into two categories: "smart set-on" and "barrage". In the former the jamming device is designed to detect a tranmission from a station local to the jamming device and to transmit a high power jamming signal concurrently with the local transmission. In the latter method the jammer transmits jamming signals continuously over a wide band to jam any reception by a local receiving station. Both these methods require the use of high power outputs and since leave-behind jammers must necessarily contain their own power supplies these high power requirements have been a major obstacle to the achievement of reductions in size and cost. It is known to have a jammer of the former type, i.e. a "smart set-on device" comprising receiving means for receiving a local radio transmission, frequency determining means for determining the frequency of the local radio transmission, and jamming signal transmitting means for transmitting a jamming signal at a frequency controlled in accordance with the frequency determined by the frequency determining means at a time subsequent to the reception of the local radio transmission by the receiving means. British Pat. Nos. 1,278,771 and 1,450,761 disclose examples of such jammers designed to jam radio transmissions in which short messages of typically one tenth of a second duration are transmitted. The jammer is designed to transmit a jamming signal concurrently with the detected transmission. The jammer has to switch rapidly between searching for transmissions and the transmission of a jamming signal in a time-scale of a few milliseconds in order to jam effectively the detected short duration signal before it ceases. This jammer requires sophisticated circuitry in both its detection and jamming stages in order to function at the high speeds required.

U.S. Pat. No. 4,214,208 discloses a further example of such a jammer. In common with other known jamming devices the jammer disclosed in this patent transmits a jamming signal concurrently with the victim signal. In this case because the victim signal is a keyed continuous wave signal of the type used in radio telegraphy the jamming signal is also keyed, having a complementary waveform with each pulse timed to follow immediately upon an individual corresponding pulse of the victim signal. As with the other devices discussed above the jamming signal has to be of substantially the same power level as the victim signal in order to be effective.

STATEMENT OF THE INVENTION

According to the present invention such a jammer is characterized in that the receiving means include monitoring means arranged to detect the end of the local radio transmission and to trigger the operation of the jammer signal transmitting means only after the end of the local radio transmission and in that the jamming signal transmitting means are arranged to transmit a low power signal for a period of time after the end of the local radio transmission so that the jammer jams local reception of a response of a non-local station to the local radio transmission.

The present invention takes advantage of some of the typical characteristics of radio communications nets to provide a jammer which while wholly effective against such nets requires far less power than known jamming devices. This method of jamming used is effective against communication nets because the messages occur not individually but consecutively in groups on the same frequency. Thus typically a transmission by a local station to a distant station is immediately followed by a transmission from the distant station back to the local station. By relying upon detection of the first step in this process, that is transmission by a local station, the present invention allows the use of a relatively simple low sensitivity receiver which responds only to transmissions at the high power level characteristic of a communications station in its immediate vicinity. However since jamming is carried out not during the transmission by the local station but subsequently during transmission from a distant station to the local station effective jamming can be achieved using low power levels: the jamming receiver has a considerable range advantage over the distant transmitting station. The efficiency of power use is further increased by transmitting jamming signals only at the one frequency of the detected transmission rather than over an entire band.

Since messages transmitted in a typical communications net last only a few seconds and even the longer ones contain critical information in the first few seconds it is necessary for the jamming device to transmit a jamming signal for only a few seconds at a time. Moreover since the jamming transceiver does not have to respond instantly to the detection of a hostile transmission but only after the cessation of the hostile transmission the present invention allows the use in the jamming device of a simple and inexpensive scanning receiver without the relatively slow search/response time of such a receiver compromising the overall performance of the device.

The simplicity and the low power requirements of a jamming transceiver in accordance with the present invention allows it to be built at relatively low cost and hence to be deployed in large numbers. As a result of the low power requirements such a jamming transceiver can be relatively compact despite the need to include an internal power source. A useful operational duration in excess of twentyfour hours can be achieved from a power supply of compact and lightweight batteries.

Preferably the monitoring means include logic circuits arranged to analyze the received local radio transmission to discriminate between hostile and non-hostile transmissions and to control the frequency determining means to stop monitoring at the frequency of non-hostile transmissions.

Preferably the jamming signal transmitting means include means for imposing an identification code on the jamming signal.

Preferably the jammer includes a local frequency oscillator common to the receiving means and the jamming signal transmitting means and a switch arranged to connect the local frequency oscillator to other components of the transmitting means when the jammer is in a transmitting mode and to other components of the receiving means when the jammer is in a receiving mode.

Preferably the local frequency oscillator is a fast-settling frequency synthesizer arranged when the jammer is in the receiving mode to scan through a range of frequencies until a local radio transmission is detected.

According to a second aspect of this invention a method of operating a jammer to disrupt radio communications comprising detecting a hostile local transmission, determining the frequency of the local transmission, subsequently transmitting a jamming signal at a frequency controlled in accordance with the determined frequency, and ceasing transmission of the jamming signal until a further local transmission is detected is characterized in that the jamming signal is transmitted only after the cessation of the local transmission to jam the local reception of a response of a non-local station to the local transmission.

BRIEF DESCRIPTION OF THE DRAWINGS

A method and device in accordance with the present invention are now described in detail with reference to the accompanying drawings in which:

FIG. 2 is a block diagram of such a device.

DESCRIPTION OF PREFERRED EXAMPLE

Figure 1:
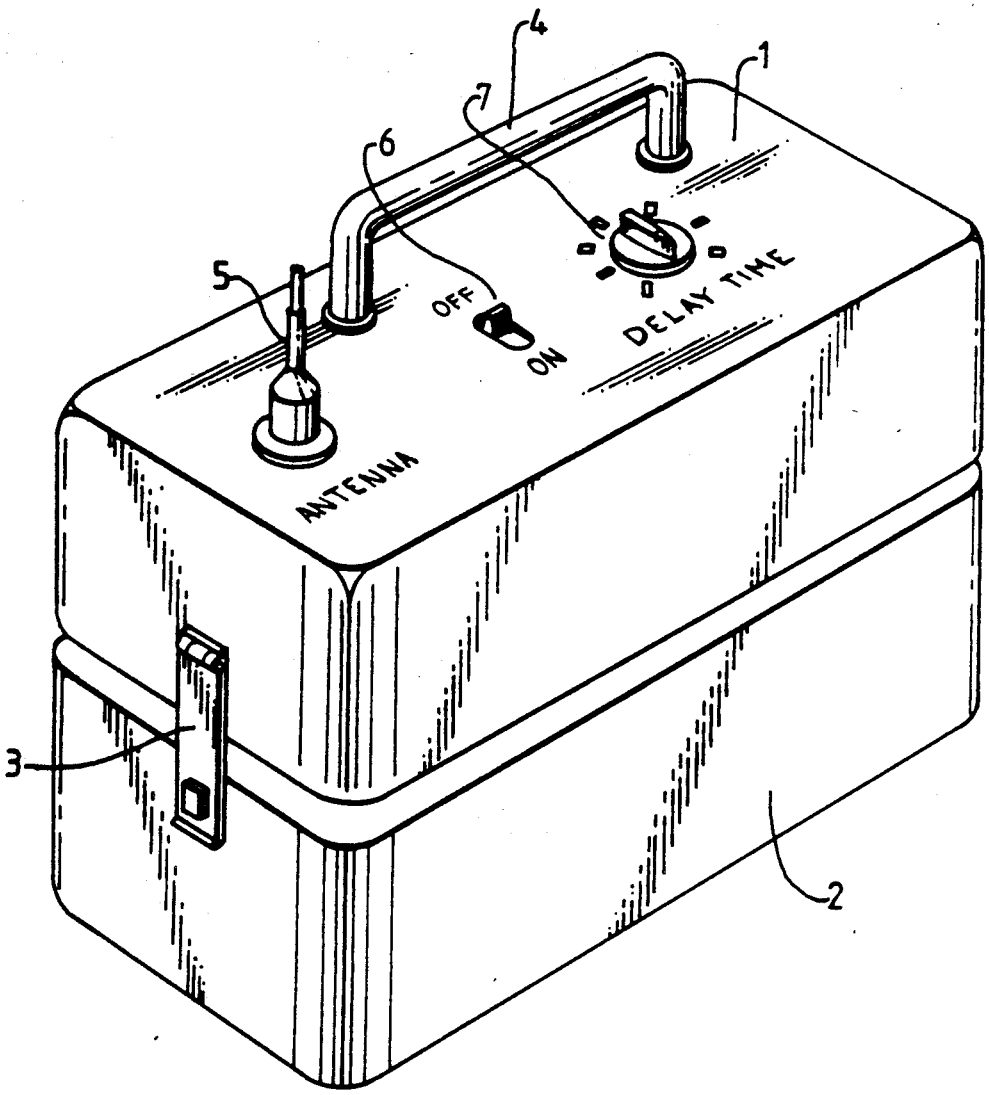
FIG. 1 is a side elevation of a jamming device in accordance with the present invention.

A jamming device in accordance with the present invention comprises a transceiver 1 and a battery 2. The transceiver 1 and the battery 2 are each contained within cast alloy cases, these cases being held together by clips 3 to provide a single compact unit which may be lifted by a fixed handle 4. An antenna 5, a switch 6 and a delay timer 7 are provided on an upper surface of the case holding the transceiver 1.

In use the operation of the transceiver is initiated by the switch 6. Detection and jamming of hostile signals may then start immediately or alternatively after the expiry of a predetermined period set on the delay timer 7. Initially the transceiver 1 is in a receive (RX) mode. In this mode the transceiver 1 scans through a range of frequencies until a signal at a level sufficiently high to be that of a local transmission is detected. This signal is then analyzed. If the signal is determined to be non-hostile, such as a transmission from another jamming device encoded with an appropriate identification signal, then the transceiver remains in the RX mode and continues to scan for hostile transmissions. Equally if the signal is found to have the characteristics of an anti-jamming decoy beacon the transceiver 1 remains in the RX mode. If however the analysis identifies the signal as being hostile then the transceiver 1 remains locked onto the frequency of the hostile signal. After the hostile transmission ceases the transceiver 1 switches to a transmission (TX) mode in which a jamming signal encoded with an appropriate identification code is transmitted for a predetermined period typically of 2 to 3 seconds duration. The transmission may start immediately after the cessation of the hostile transmission or alternatively following a predetermined delay, according to the known characteristics of the communications net being jammed.

In general transmission and reception by the stations of a communications net take place at a single frequency. In this case to jam reception of transmission from a distant station by a local station it is sufficient for the jamming device to transmit a jamming signal at the same frequency as the detected local transmission. If however the communications net is of the type using duplex operation with a predetermined frequency offset between received and transmitted signals then the transceiver is preprogrammed to transmit the jamming signal at a frequency separated from the frequency of the detected local transmission by a corresponding offset.

After transmitting the jamming signal for the predetermined period the transceiver returns to the RX mode until a further local hostile transmission is detected.

Because of the low power required to jam local reception of transmission by a distant station the power consumption of a jamming device using this method of operation is exceptionally low. Effective jamming can be achieved using output powers less than 50 Watts and typically in a range as low as 1–10 Watts. Typically the battery 3 is of the 12 volt 10 Ampere-hour Manganese-alkaline type. As a result of the low power requirements such a battery can power continuous operation of the jamming device for over twentyfour hours. The combined weight of a battery together with the transceiver 1 is typically little more than 1 Kg and the jamming device as a whole may have a volume of less than two liters.

The design of the transceiver is shown schematically in FIG. 2. The receiving stages of the transceiver 1 are formed by a homodyne receiver in which the local oscillator (LO) signal is supplied by a fast-settling frequency synthesizer 8 when the transceiver is in the RX mode. Since receive and transmit periods do not overlap this same local oscillator 8 is also used to provide the jamming waveform (with suitable modulation AM or FM imposed) when the transceiver is in the TX mode. This use of a single oscillator considerably simplifies construction. A simple RX/TX switch 12 serves to connect the power amplifier in the circuit in the TX mode.

As the intermediate frequency (IF) is zero in a homodyne receiver the usual IF filter is replaced by an active low-pass filter operating at audio frequencies (AF). As this filter needs no inductive or crystal components it is put with the rest of the signal circuitry on a chip-carrier or hybrid circuit to aid miniaturization.

The synthesizer frequency is controlled digitally by the output of a digital counter 9 which also feeds the address lines of a read/write memory 10. This allows each frequency to be checked against a preprogrammed list of those frequencies known to be associated with hostile transmissions while that frequency is being received. This preprogrammed list may be updated during the operation of the jamming device if required. If the frequency is associated with non-hostile transmissions, or if no signal appears above the detector threshold, the counter 9 may be stepped onto the next frequency. If a signal is detected control logic circuits 11 can time its duration and decide whether to jam when its stops or alternatively to ignore it or to move on to the next frequency.

The jamming logic may be integrated on a gate-array or alternatively implemented by software in a microprocessor.

I claim:

1. An apparatus for jamming communication between a local station and a distant station comprising:

receiving means for receiving a message from a local radio transmission, means including monitoring means for detecting the end of said local radio transmission message, frequency determining means operatively connected to said receiving means for determining a frequency of said local radio transmission received by said receiving means, jamming signal transmitting means operatively connected to said frequency determining means for transmitting a jamming signal at a frequency controlled in accordance with said frequency determined by said frequency determining means at a time subsequent to reception of said local radio transmission by said receiving means, and means responsive to detection by said monitoring means of the end of said local radio transmission message for initiating operation of said jamming signal transmitting means only after said end of said local radio transmission message and for a predetermined period of time after said end of said local radio transmission message for jamming local reception of a response from said distant station for said predetermined period of time.

2. Apparatus according to claim 1, wherein said monitoring means include logic circuits for analyzing said local radio transmission to discriminate between hostile and non-hostile transmissions and, in the case that said local radio transmission is determined to be non-hostile, for controlling said frequency determining means to stop monitoring at a frequency of said local radio transmission.

3. Apparatus according to claim 1, further comprising local frequency oscillator means and a switch operatively connected to said local frequency oscillator means, to said receiving means and to said jamming signal transmitting means and for connecting said local frequency oscillator means to said jamming signal transmitting means when said apparatus is in a transmitting mode and for connecting said local frequency oscillator means to said receiving means when said apparatus is in receiving mode.

4. Apparatus according to claim 3, wherein said local frequency oscillator means includes a fast-settling frequency synthesizer arranged when said apparatus is in said receiving mode to scan through a range of frequencies until a local radio transmission is detected.

5. An apparatus for jamming communication between a local station and a distant station comprising:

receiving means for receiving a local radio transmission and means including monitoring mean for detecting cessation of said local radio transmission;

frequency determining means operatively connected to said receiving means for determining a frequency of said local radio transmission received by said receiving means;

jamming signal transmitting means operatively connected to said frequency determining means for transmitting a jamming signal at a frequency controlled in accordance with said frequency determined by said frequency determining means at a time subsequent to reception of said local radio transmission by said receiving means, said jamming signal transmitting means including encoding means for imposing an identification code of said jamming signal;

means responsive to said cessation for initiating operation of said jamming signal transmitting means only after said cessation of said local radio transmission and for a predetermined period of time after said cessation of said local radio transmission for jamming local reception of a response from said distant station;

said monitoring means comprising logic circuits for analyzing said local radio transmission to discriminate between hostile and non-hostile transmissions and, in the case that said local radio transmission is determined to be non-hostile, for controlling said frequency determining means to stop monitoring at a frequency of said local radio transmission.

6. A method for jamming a response from a distant station to a transmission from a local station comprising the steps of:

detecting a hostile message in a transmission from said local station to said distant station;

determining a frequency of said local transmission;

detecting the end of said hostile message;

subsequently transmitting a jamming signal at a frequency controlled in accordance with said determined frequency, only after said end of said hostile message thereby jamming local reception of a response from said distant station during transmission of said jamming signal; and ceasing transmission of said jamming signal until a further local transmission is detected.

7. A method according to claim 6, further comprising the steps of analyzing said local transmission to discriminate between hostile and non-hostile transmission and, in the case that said local transmission is determined to be non-hostile, ceasing monitoring of said local transmission.

8. A method for jamming communication between a local station and a distant station comprising the steps of:

detecting a hostile transmission;

determining a frequency of said hostile local transmission;

analyzing said local transmission to discriminate between hostile and non-hostile transmission and, in the case that said local transmission is determined to be non-hostile, ceasing monitoring of said local transmission; and detecting cessation of said hostile local transmission;

subsequently transmitting a jamming signal at a frequency controlled in accordance with said determined frequency, only after said cessation thereby jamming local reception of a response from said distant station;

imposing an identification code on said jamming signal; and ceasing transmission of said jamming signal until a further local transmission is detected.

9. A method according to claim 8, wherein said step of analyzing said local transmission includes determining whether said local transmission includes a code identifying said local transmission as non-hostile.

* * * * *